US011905474B2

(12) United States Patent
Jeon et al.

(10) Patent No.: US 11,905,474 B2
(45) Date of Patent: Feb. 20, 2024

(54) APPARATUS AND METHOD FOR REFINING WASTE PLASTIC PYROLYSIS OIL USING A SEPARATOR

(71) Applicants: SK Innovation Co., Ltd., Seoul (KR); SK Geo Centric Co., Ltd., Seoul (KR)

(72) Inventors: Hee Jung Jeon, Daejeon (KR); Ok Youn Kim, Daejeon (KR); Ka Young Kim, Daejeon (KR); Young Moo Park, Daejeon (KR); Ho Won Lee, Daejeon (KR)

(73) Assignees: SK Innovation Co., Ltd., Seoul (KR); SK Geo Centric Co., Ltd., Seoul (KR)

( * ) Notice: Subject to any disclaimer, the term of this patent is extended or adjusted under 35 U.S.C. 154(b) by 0 days.

(21) Appl. No.: 17/863,875

(22) Filed: Jul. 13, 2022

(65) Prior Publication Data

US 2023/0035706 A1 Feb. 2, 2023

(30) Foreign Application Priority Data

Jul. 14, 2021 (KR) ..... 10-2021-0092162

(51) Int. Cl.
*C10G 65/04* (2006.01)
*C10G 45/72* (2006.01)

(52) U.S. Cl.
CPC ..... *C10G 65/04* (2013.01); *C10G 45/72* (2013.01); *C10G 2300/201* (2013.01); *C10G 2300/4006* (2013.01); *C10G 2300/4012* (2013.01)

(58) Field of Classification Search
CPC ..... C10G 65/04; C10G 2300/4006
See application file for complete search history.

(56) References Cited

U.S. PATENT DOCUMENTS

| | | | |
|---|---|---|---|
| 3,935,295 | A | 1/1976 | La Hue et al. |
| 2013/0001133 | A1 | 1/2013 | Zhan et al. |
| 2017/0349846 | A1 | 12/2017 | Ding et al. |
| 2021/0277324 | A1 | 9/2021 | Toukoniitty et al. |

FOREIGN PATENT DOCUMENTS

| | | | | |
|---|---|---|---|---|
| CN | 101845323 | A | | 9/2010 |
| CN | 103980938 | A | * | 8/2014 |
| CN | 103980938 | A | | 8/2014 |
| JP | 3544603 | B2 | | 7/2004 |
| KR | 1020190015391 | A | | 2/2019 |
| KR | 1020210034636 | A | | 3/2021 |
| WO | 2018025104 | A1 | | 2/2018 |

OTHER PUBLICATIONS

Chen, CN 103980938 A , English translation (2014).*

* cited by examiner

*Primary Examiner* — Randy Boyer
(74) *Attorney, Agent, or Firm* — The Webb Law Firm

(57) ABSTRACT

Provided are an apparatus and a method for refining pyrolysis oil in which a dechlorination reaction is performed under a first hydrotreating catalyst. Hydrogen chloride as a by-product is removed, and then a denitrification reaction is performed under a second hydrotreating catalyst, thereby preventing production of an ammonium salt ($NH_4Cl$), and providing refined oil. It is excellent in prevention of corrosion of a reactor, improvement of durability, occurrence of differential pressure, process efficiency, has very low contents of impurities such as chlorine, nitrogen, and metal and olefin, and has excellent quality.

3 Claims, 1 Drawing Sheet

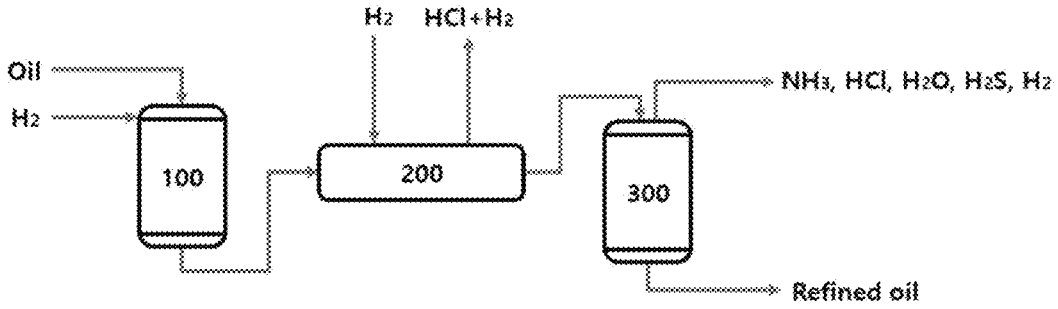
Oil
H2
100
H2
HCl+H2
200
NH3, HCl, H2O, H2S, H2
300
Refined oil

APPARATUS AND METHOD FOR REFINING WASTE PLASTIC PYROLYSIS OIL USING A SEPARATOR

CROSS REFERENCE TO RELATED APPLICATION

The application claims priority to Korean Patent Application No. 10-2021-0092162, filed Jul. 14, 2021, the disclosure of which is hereby incorporated by reference in its entirety.

BACKGROUND OF THE INVENTION

Field of the Invention

The following disclosure relates to an apparatus and a method for refining waste plastic pyrolysis oil.

Description of Related Art

Waste plastic is manufactured using petroleum as a raw material, and has a low recyclability and is mostly disposed of as garbage. These forms of wastes decompose in their natural state, and since the decomposition takes a long time, they pollute the soil and cause serious environmental pollution. As a method of recycling waste plastic, the waste plastic may be pyrolyzed and converted into oil, which is referred to as waste plastic pyrolysis oil.

However, since pyrolysis oil obtained by pyrolyzing waste plastic has a higher content of impurities such as chlorine, nitrogen, and metal as compared with oil manufactured from crude oil by a common method, it may not be directly used as high value-added fuels such as gasoline and diesel oil and should go through a refining process. As such, as a refining method for removing impurities such as chlorine, nitrogen, and metal contained in the waste plastic pyrolysis oil, a dechlorination/denitrification method by reacting waste plastic pyrolysis oil and hydrogen in the presence of a hydrotreating catalyst or a method of removing chlorine contained in the waste plastic pyrolysis oil by adsorption using a chlorine adsorbent.

Specifically, U.S. Pat. No. 3,935,295 discloses a technology for removing chloride pollutants from various hydrocarbon oils. The technology is a conventional technology of hydrogenating oil in the presence of a hydrotreating catalyst in a first reactor, introducing a fluid including produced hydrogen chloride (HCl) refined oil to a second reactor, and then removing a chlorine component included in the fluid by adsorption using an adsorbent.

However, as described in the conventional technology, when oil and hydrogen react in the presence of a hydrotreating catalyst, a nitrogen compound and a chlorine compound such as hydrogen chloride produced with the refined oil react to produce an ammonium salt ($NH_4Cl$), and this ammonium salt causes various process problems. Specifically, an ammonium salt produced inside the reactor by the reaction of oil and hydrogen causes corrosion of the reactor to decrease durability, and causes many process problems such as occurrence of differential pressure and lower process efficiency therefrom.

Therefore, in a process of refining waste plastic pyrolysis oil containing impurities including chlorine and nitrogen, an apparatus and a method for refining waste plastic pyrolysis oil in which a chlorine component and a nitrogen component are prevented from reacting to produce an ammonium salt ($NH_4Cl$), or produce the ammonium salt in a minimum amount, is demanded.

RELATED ART DOCUMENTS

Patent Documents (Patent Document 1) U.S. Pat. No. 3,935,295 (registration date: Jan. 27, 1976)

SUMMARY OF THE INVENTION

An embodiment of the present invention is directed to providing an apparatus and a method for refining waste plastic pyrolysis oil which prevent or minimize production of an ammonium salt ($NH_4Cl$), and have an improvement in prevention of corrosion of a reactor, durability, differential pressure occurrence, and process efficiency, in a process of refining waste plastic pyrolysis oil containing impurities including chlorine and nitrogen.

Another embodiment of the present invention is directed to providing an apparatus and a method for refining waste plastic pyrolysis oil, which have a very low content of impurities such as chlorine, nitrogen, and metal and a very low content of olefin, and have excellent quality.

In one general aspect, an apparatus for refining waste plastic pyrolysis oil includes: a guard bed to which the waste plastic pyrolysis oil and hydrogen are introduced and in which a dechlorination reaction is performed under a first hydrotreating catalyst; a separator to which a fluid including hydrogen chloride discharged from the guard bed is introduced and in which the hydrogen chloride is removed from the fluid; and a main bed to which a fluid from which hydrogen chloride has been removed in the separator is introduced and in which a denitrification reaction is performed under a second hydrotreating catalyst.

In an exemplary embodiment of the present invention, control may be carried out so that the following Equation 1 may be satisfied:

$$(|T_1/T_2|)\log\frac{Cl_0}{Cl_1} \leq \log\frac{N_1}{N_2} \quad \text{[Equation 1]}$$

wherein $T_1$: first temperature (K), $T_2$: second temperature (K), $Cl_0$: weight of chlorine contained in waste plastic pyrolysis oil introduced to the guard bed, $Cl_1$: weight of chlorine in an oil fraction immediately after passing through the guard bed, $N_1$: weight of nitrogen in an oil fraction immediately after passing through the guard bed, $N_2$: weight of nitrogen in an oil fraction immediately after passing through the main bed.

In an exemplary embodiment of the present invention, hydrogen chloride discharge paths other than a path to the separator may be excluded in the guard bed.

In an exemplary embodiment of the present invention, separate hydrogen may be introduced to the separator, hydrogen chloride in the fluid in the separator may be removed by hydrogen introduced to the separator, and the hydrogen may be removed by replacing the hydrogen with hydrogen chloride and discharging it from the separator.

In an embodiment of the present invention, a fluid temperature in the separator may be 40° C. to 100° C.

In an exemplary embodiment of the present invention, from the main bed, mixed gas including ammonia and hydrogen chloride which has not been removed from in separator and refined waste plastic pyrolysis oil may be discharged, respectively.

In an exemplary embodiment of the present invention, a pressure in the dechlorination reaction or the denitrification reaction may be 1 to 100 bar.

In an exemplary embodiment of the present invention, a volume flow ratio of the waste plastic pyrolysis oil and hydrogen introduced to the guard bed based on 1 atm may be 1:300 to 3,000.

In an exemplary embodiment of the present invention, the first hydrotreating catalyst may be a hydrodechlorination catalyst, and the second hydrotreating catalyst may be a hydrodenitrification catalyst.

In an exemplary embodiment of the present invention, the waste plastic pyrolysis oil may include 0.03 wt % or more of nitrogen and 0.003 wt % or more of chlorine based on the total weight of the pyrolysis oil.

In another general aspect, a method for refining waste plastic pyrolysis oil according to the present invention includes: a dechlorination step of dechlorinating waste plastic pyrolysis oil and hydrogen under a first hydrotreating catalyst to produce a fluid including hydrogen chloride; a hydrogen chloride removal step of separating and removing hydrogen chloride from the fluid; and a denitrification step of denitrifying the fluid from which hydrogen chloride is separated under a second hydrotreating catalyst.

In an exemplary embodiment of the present invention, in the hydrogen chloride removal step, separate hydrogen is supplied to the fluid to remove hydrogen chloride, and the hydrogen chloride may be removed by replacing the hydrogen chloride with the hydrogen supplied.

In an exemplary embodiment of the present invention, the dechlorination reaction may be performed at a first temperature, and the denitrification reaction may be performed at a second temperature higher than the first temperature.

In an exemplary embodiment of the present invention, the first temperature may be 100° C. to 300° C. and the second temperature may be higher than 280° C. and 450° C. or less.

In an exemplary embodiment of the present invention, a difference between the first temperature and the second temperature may be 50° C. to 350° C.

Other features and aspects will be apparent from the following detailed description, the drawings, and the claims.

BRIEF DESCRIPTION OF THE DRAWINGS

FIG. 1 is a process diagram which schematically illustrates a method for refining waste plastic pyrolysis oil according to the present invention.

DETAILED DESCRIPTION OF MAIN ELEMENTS

100: Guard bed
200: Separator
300: Main bed

DESCRIPTION OF THE INVENTION

Hereinafter, the apparatus and the method for refining waste plastic pyrolysis oil using a separator according to the present invention will be described in detail with reference to the accompanying drawings.

The drawings illustrated in the present specification are provided by way of example so that the idea of the present invention may be sufficiently conveyed to a person skilled in the art. Therefore, the present invention is not limited to the provided drawings, but may be embodied in many different forms, and the drawings may be exaggerated in order to clear the spirit of the present invention. Technical terms and scientific terms used in the present specification have the general meaning understood by those skilled in the art to which the present invention pertains unless otherwise defined, and a description for the known function and configuration obscuring the gist of the present invention will be omitted in the following description and the accompanying drawings.

The singular form of the term used herein may be intended to also include a plural form, unless otherwise indicated.

The numerical range used in the present specification includes all values within the range including the lower limit and the upper limit, increments logically derived in a form and span in a defined range, all double limited values, and all possible combinations of the upper limit and the lower limit in the numerical range defined in different forms. Unless otherwise defined in the specification of the present invention, values which may be outside a numerical range due to experimental error or rounding of a value are also included in the defined numerical range.

The term "comprise" mentioned in the present specification is an open-ended description having a meaning equivalent to the term such as "is/are provided", "contain", "have", or "is/are characterized", and does not exclude elements, materials, or processes which are not further listed.

The unit of % used herein without particular mention refers to % by weight, unless otherwise defined.

The term "layer" or "film" mentioned in the present specification means that each material forms a continuum and has a dimension having a relatively small thickness to a width and a length. Accordingly, it should not be interpreted as a two-dimensional flat plane by the term "layer" or "film".

The waste plastic pyrolysis oil mentioned in the present invention refers to a hydrocarbon oil mixture produced by pyrolysis of waste plastic. The mixture may include impurities such as a chlorine compound, a nitrogen compound, and a metal compound, in addition to a hydrocarbon oil; impurities present in the form of a compound to which chlorine, nitrogen, or metal is bonded in the hydrocarbon; and hydrocarbons in the form of olefin which is not required. As a specific example, the waste plastic pyrolysis oil may contain 0.03 wt % or more, specifically 0.07 wt % of nitrogen and 0.003 wt %, specifically 0.03 wt % or more of chlorine, and may contain 20 wt % or more of olefin and 1 wt % or more, specifically 1.5 wt % or more of conjugated olefin.

In refining waste plastic pyrolysis oil, when impurities are removed by a hydrogenation reaction under a hydrotreating catalyst, hydrogen chloride (HCl) which is a by-product produced by the hydrogenation reaction is produced. Hydrogen chloride causes corrosion of an apparatus itself, and in particular, reacts with a nitrogen compound in an apparatus to produce an ammonium salt ($NH_4Cl$), and the ammonium salt causes many process problems such as occurrence of differential pressure and decreased process efficiency therefrom as well as decreased durability of a reactor. U.S. Pat. No. 3,935,295 uses a method of removing the produced hydrogen chloride using an adsorbent by adsorption, by installing the adsorbent in the rear end of a hydrogenation reactor, for removing hydrogen chloride. However, since in the U.S. Patent Registration, a nitrogen component is also produced with hydrogen chloride during a hydrogenation reaction, hydrogen chloride and a nitrogen component react to produce an ammonium salt. Therefore, conventionally, only an object to remove hydrogen chloride and a means therefor exist, and an object to remove an ammonium salt and a means therefor have not been studied, and thus, there was a limitation in that accumulation of an ammonium salt produced inside a reactor was not avoided.

Thus, in the present invention, a dechlorination reaction is performed under a first hydrotreating catalyst to remove hydrogen chloride as a by-product, and then a denitrification reaction is performed under a second hydrotreating catalyst, that is, a dechlorination reaction and a denitrification reaction are performed separately, but hydrogen chloride is separated and removed before the denitrification reaction, thereby minimizing accumulation of an ammonium salt produced by the reaction of hydrogen chloride and a nitrogen component. Therefore, the present invention provides an apparatus and a method for refining waste plastic pyrolysis oil, which prevents many process problems such as corrosion of an apparatus by an ammonium salt, occurrence of differential pressure, and decreased process efficiency therefrom. Specifically, the apparatus for refining waste plastic pyrolysis oil includes: a guard bed 100 to which the waste plastic pyrolysis oil and hydrogen are introduced and in which a dechlorination reaction is performed under a first hydrotreating catalyst; a separator 200 to which a fluid including hydrogen chloride discharged from the guard bed 100 is introduced and in which the hydrogen chloride is removed from the fluid; and a main bed 300 to which a fluid from which hydrogen chloride has been removed in the separator 200 is introduced and in which a denitrification reaction is performed under a second hydrotreating catalyst.

As mentioned above, in the present invention, in order to minimize accumulation of an ammonium salt (ammonium chloride) produced by the reaction of a chlorine compound (hydrogen chloride) and a nitrogen compound (ammonia) which are by-products during a process of refining waste plastic pyrolysis oil, a dechlorination reaction to produce a chlorine compound and a denitrification reaction to produce a nitrogen compound are performed in separate reactors, and a separator is placed between each reactor so that the amount of a chlorine compound introduced to the reactor in which a nitrification reaction is performed is minimized, thereby removing the chlorine compound by separation. Therefore, production of the ammonium salt may be minimized.

As described above, the guard bed 100 and the main bed 300 are provided with a hydrotreating catalyst, respectively to perform a hydrogenation reaction. Here, a dechlorination reaction is performed in the guard bed 100, a denitrification reaction is performed in the main bed 300, and a difference in the type of decomponent of each reaction may be determined by a reaction temperature.

Preferably, the dechlorination reaction may be performed at a first temperature, and the denitrification reaction may be performed at a second temperature higher than the first temperature.

The first temperature mentioned in the present invention is a temperature at which the dechlorination reaction is performed, and the second temperature is a temperature at which the denitrification reaction is performed. Specifically, the first temperature at which the dechlorination reaction is performed may be 100 to 280° C., preferably 120° C. to 250° C., and more preferably 150° C. to 230° C. The second temperature at which the denitrification reaction is performed may be higher than 280 and 450° C. or less, preferably 290° C. to 430° C., and more preferably 300° C. to 400° C. In addition, a difference between the first temperature and the second temperature may be 50° C. to 350° C., preferably 70° C. to 280° C., and more preferably 100° C. to 200° C.

A reaction pressure of the guard bed 100 or the main bed 300 is not largely limited, but 100 bar or less, specifically 1 to 100 bar, and more specifically 1 to 70 bar may be preferred in terms of further suppressing production of an ammonium salt.

More specifically, for the description of the guard bed 100, in the guard bed 100, there is a dechlorination reaction region provided with a first hydrotreating catalyst so that a dechlorination reaction is performed. Waste plastic pyrolysis oil and hydrogen are introduced to the guard bed 100, and these react with each other under the first hydrotreating catalyst to perform a dechlorination reaction. In addition, a reaction in which a part of olefin and metal impurities are removed from the waste plastic pyrolysis oil is also performed in addition to the dechlorination reaction. More specifically, when waste plastic pyrolysis oil and hydrogen are introduced to the reaction region in the guard bed 100, a hydrogenation reaction of the waste plastic pyrolysis oil occurs under a hydrotreating catalyst and most of chlorine is removed from the waste plastic pyrolysis oil to produce hydrogen chloride. Besides, a part of olefin is removed and other metal impurities are removed from the waste plastic pyrolysis oil. The fluid including a dechlorinated oil fraction from which other impurities are removed, hydrogen chloride, and unreacted hydrogen as such is introduced to a separator 200.

More specifically, for the description of the separator 200, the separator 200 may be various as long as it may separate hydrogen chloride from oil in a fluid including oil and hydrogen chloride and remove hydrogen chloride from the fluid. As a preferred example, as shown in FIG. 1, the separator 200 may be a gas-gas separation method by supply of certain gas, and when hydrogen is used as the certain gas, it may be used as a reactant for a denitrification reaction of the main bed 300 later, which is thus preferred. Specifically, separate hydrogen is introduced to the separator 200, hydrogen chloride in a fluid in the separator 200 is removed by hydrogen introduced to the separator 200, and hydrogen is replaced with the hydrogen chloride which is removed by discharge from the separator 200. That is, by hydrogen introduced to the separator 200, hydrogen chloride in the fluid may be discharged from the separator 200, and separated and removed, and here, the hydrogen chloride and a part of hydrogen may be discharged together. In addition, hydrogen from a path different from that of hydrogen in the fluid introduced from the guard bed 100 may be introduced to the separator 200, to remove hydrogen chloride from the fluid.

To the apparatus for refining waste plastic pyrolysis oil according to an exemplary embodiment of the present invention, a fluid including hydrogen chloride discharged from the separator 200 and a part of hydrogen is introduced, and the apparatus may further include a hydrogen/hydrogen chloride separation unit which separates hydrogen chloride and hydrogen and discharge each of them. As a separation means in the hydrogen/hydrogen chloride separation unit, various methods may be used, and for example, any one or two or more selected from a membrane separation means through a hydrogen permeable separator, an adsorption separation means through a hydrogen chloride adsorber, and a dissolution separation means through an aqueous alkaline solution having high solubility in hydrogen chloride may be included.

When the separation means is a membrane separation means, a fluid including hydrogen chloride discharged from the separator 200 and a part of hydrogen is introduced to the apparatus for refining waste plastic pyrolysis oil according to an exemplary embodiment of the present invention, and the apparatus may further include a hydrogen/hydrogen chloride separation unit equipped with a hydrogen permeable separator which separates hydrogen chloride and hydrogen from the fluid. The hydrogen permeable separator serves not to allow permeation of hydrogen chloride while allowing permeation of hydrogen in the fluid including hydrogen and hydrogen chloride discharged from the separator 200. Therefore, hydrogen passing through the separator and a fluid including hydrogen chloride which does not pass through the separator may be separated and discharged, respectively. The hydrogen permeable separator may be various known ones as long as it is a separator having a high hydrogen permeability and a low hydrogen chloride permeability, and for example, may be a dense separator or a porous separator. As a preferred example, the hydrogen permeable separator may be preferably a dense separator including a palladium metal; or an alloy of a dissimilar metal including any one or two or more selected from copper, silver, ruthenium, and the like with palladium, in terms of better separation characteristics with hydrogen chloride. The thickness of the separator may be appropriately adjusted, and as an example, may be 1 to 300 μm. However, this is described as a preferred example, and the present invention is not interpreted as being limited thereto.

When the separation means is an adsorption separation means, a fluid including hydrogen chloride discharged from the separator 200 and a part of hydrogen is introduced to the apparatus for refining waste plastic pyrolysis oil according to an exemplary embodiment of the present invention, and the apparatus may further include a hydrogen/hydrogen chloride separation unit equipped with a hydrogen chloride adsorbent which separates hydrogen chloride and hydrogen from the fluid. The adsorbent may be various known kinds as long as it selectively adsorbs hydrogen chloride gas and may adsorb hydrogen chloride. As a specific example, the adsorbent may include any one or two or more selected from metal oxides, metal hydroxides, metal carbides, and the like. The metal of the metal oxide, the metal hydroxide, and the metal carbide of the adsorbent may include any one or two or more selected from calcium, magnesium, aluminum, iron, and the like. As a specific example, the adsorbent may include any one or two or more selected from calcium oxide, magnesium oxide, aluminum oxide, iron oxide ($Fe_3O_4$, $Fe_2O_3$), calcium hydroxide, magnesium hydroxide, aluminum hydroxide, iron hydroxide, iron carbide (Fe—C composite), calcium carbide (CaH—C composite), and the like. However, this is described as a preferred example, and the present invention is not interpreted as being limited thereto.

When the separation means is a solubility separation means, a fluid including hydrogen chloride discharged from the separator 200 and a part of hydrogen is introduced to the apparatus for refining waste plastic pyrolysis oil according to an exemplary embodiment of the present invention, and the apparatus may further include a hydrogen/hydrogen chloride separation unit including an alkaline solution which separates hydrogen chloride and hydrogen from the fluid. When hydrogen chloride comes into contact with the aqueous alkaline solution, hydrogen chloride is dissolved in and reacts with the aqueous alkaline solution to selectively remove hydrogen chloride from the fluid. As the aqueous alkaline solution, various aqueous alkaline solutions such as an aqueous sodium hydroxide solution and an aqueous calcium hydroxide solution may be used. The apparatus for refining waste plastic pyrolysis oil according to a preferred exemplary embodiment may further include a hydrogen/hydrogen chloride separation unit provided with a hydrogen permeable separator to which a fluid including hydrogen chloride and a part of hydrogen discharged from the separator 200 is introduced and which separates hydrogen chloride and hydrogen from the fluid; and a hydrogen chloride adsorbent to which a fluid including hydrogen separated by the hydrogen permeable separator is introduced and which separates hydrogen chloride and hydrogen from the fluid. Here, a fluid flow introduced to the adsorbent may be both a fluid flow including hydrogen chloride which does not pass through the hydrogen permeable separator and a fluid flow including hydrogen which passes through the hydrogen permeable separator. Separation ability of hydrogen and hydrogen chloride may be further improved by the multi-stage separation process as such.

Each of the fluids including hydrogen chloride discharged from the hydrogen/hydrogen chloride separation unit of various means and hydrogen may be recycled and reused by various means. As a preferred example, hydrogen separated and discharged from the hydrogen/hydrogen chloride separation unit may be reintroduced to the guard bed 100 and/or the separator 200 and reused.

The apparatus for refining waste plastic pyrolysis oil according to an exemplary embodiment of the present invention may include a first hydrogen storage tank which supplies first hydrogen to the guard bed 100; and a second hydrogen storage tank which supplies second hydrogen to the separator 200. Here, the first hydrogen storage tank and the second hydrogen storage tank may be the same hydrogen storage tank or separated hydrogen storage tanks. First hydrogen from the first hydrogen storage tank is introduced to the guard bed 100 and dechlorinated with waste plastic pyrolysis oil. Second hydrogen from the second hydrogen storage tank is introduced to the separator 200, and the second hydrogen is replaced with hydrogen chloride in the fluid in the separator 200, thereby removing hydrogen chloride from the fluid.

As a non-limiting example, hydrogen chloride discharge paths or gas discharge paths including the same other than the path introduced to the separator 200 may be excluded from the guard bed 100. That is, the fluid including the product reacting in the guard bed 100 and unreacted products may be introduced to the separator 200 as it is. As a specific example, it is preferred that the guard bed 100 has no separate gas outlet.

The temperature in the separator 200 is not largely limited since it may be appropriately controlled as long as hydrogen chloride may be removed, and for example, it may be adjusted so that a fluid temperature is 40° C. to 100° C. However, this is described as a specific example, and the present invention is not interpreted as being limited thereto.

More specifically, for the description of the main bed 300, in the main bed 300, there is a denitrification reaction region provided with a second hydrotreating catalyst so that a denitrification reaction is performed. The waste plastic pyrolysis oil from which hydrogen chloride has been removed and hydrogen are introduced from the separator 200 to the main bed 300, and these react with each other under the second hydrotreating catalyst to perform a denitrification reaction. In addition, a reaction to remove also other impurities such as a sulfur component and an oxygen component with a small amount of hydrogen chloride which is not removed in addition to the denitrification reaction is performed. Further, mixed gas including ammonia, a small amount of not-removed hydrogen chloride, water, hydrogen sulfide, hydrogen, and the like present inside the main bed 300 is discharged from the main bed 300, and refined waste plastic pyrolysis oil is obtained by gas-liquid separation from the mixed gas. More specifically, ammonia ($NH_3$) gas may be produced by a denitrification reaction in the reaction region in the main bed 300, and the produced ammonia gas may react with hydrogen chloride gas to produce an ammonium salt. Therefore, the main bed 300 may be provided with a gas outlet from which ammonia gas or mixed gas including the same is discharged.

It is preferred that the apparatus for refining waste plastic pyrolysis oil according to the present invention is controlled so that the following Equation 1 is satisfied. When the equation is satisfied, production and accumulation of the ammonium salt in the reactor may be extremely minimized.

$$(|T_1/T_2|)\log\frac{Cl_0}{Cl_1} \leq \log\frac{N_1}{N_2} \quad \text{[Equation 1]}$$

wherein $T_1$: first temperature (K), $T_2$: second temperature (K), $Cl_0$: weight of chlorine contained in waste plastic pyrolysis oil introduced to the guard bed 100, $Cl_1$: weight of chlorine in an oil fraction immediately after passing through the guard bed 100, $N_1$: weight of nitrogen in an oil fraction immediately after passing through the guard bed 100, $N_2$: weight of nitrogen in an oil fraction immediately after passing through the main bed 300.

Specifically, in Equation 1, $T_1$ is a first temperature (K) and is a reaction temperature of the guard bed, and $T_2$ is a second temperature (K) and is a reaction temperature of the main bed 300. In addition, $Cl_0$ is a weight of chlorine contained in initial unrefined waste plastic pyrolysis oil, and $Cl_1$ is a weight of chlorine in an oil fraction in a fluid disposed between the guard bed 100 and the main bed 300. Further, $N_1$ is a weight of nitrogen in an oil fraction in a fluid disposed between the guard bed 100 and the main bed 300, and $N_2$ is a weight of nitrogen in an oil fraction in a fluid immediately after passing through the main bed 300 or a weight of nitrogen in finally discharged refined oil. That is, since the fluid passing through the guard bed 100 before introduced to the main bed 300 is a fluid before performing the denitrification reaction, a weight of chlorine in an oil fraction in the fluid is significantly decreased as compared with the initial state, but a weight of nitrogen in an oil fraction in the fluid is not greatly decreased, and then the fluid passes through the main bed 300 to greatly decrease the weight of nitrogen in an oil fraction in the fluid.

As described above, the apparatus for refining waste plastic pyrolysis oil according to the present invention includes a guard bed 100 to which the waste plastic pyrolysis oil and hydrogen are supplied and in which the dechlorination reaction is performed under a hydrotreating catalyst, wherein a supply flow rate of the waste plastic pyrolysis oil and the hydrogen introduced is only a flow rate at which the dechlorination reaction may be performed, and for example, a volume flow rate based on 1 atm may be 1:300 to 3,000, specifically 1:500 to 2,500. However, this is described as a preferred example, and the present invention is not interpreted as being limited thereto.

The hydrotreating catalyst mentioned in the present invention, specifically, a first hydrotreating catalyst or a second hydrotreating catalyst, may be various known kinds of catalysts as long as it allows a hydrogenation reaction to add hydrogen to hydrocarbon oil of waste plastic pyrolysis oil to be performed. As a specific example, the hydrotreating catalyst may include any one or two or more selected from a hydrodesulfurization catalyst, a hydrodenitrification catalyst, a hydrodechlorination catalyst, a hydrodemetallization catalyst, and the like. The catalyst allows the denitrification reaction or the dechlorination reaction to be performed depending on the conditions such as temperature described above, as a demetallization reaction is performed. As a specific example, the catalyst may be those having an active metal having hydrotreating catalytic ability, and preferably, an active metal may be supported on a support. Any active metal may be used as long as it has required catalytic ability, and for example, may include any one or more selected from molybdenum, nickel, and the like. Any support may be used as long as it has durability to support the active metal, and for example, may include any one or two or more selected from metal including any one or two or more selected from aluminum, zirconium, sodium, titanium, and manganese, and the like; oxides of the metal; and carbon-based materials including any one or two or more selected from carbon black, active carbon, graphene, carbon nanotubes, graphite, and the like; and the like. A specific example may be a catalyst which is a support on which an active metal including 0.1 to 10 wt % of nickel and 0.1 to 30 wt % of molybdenum with respect to the total weight is supported. However, this is described as a specific example, and the present invention is not interpreted as being limited thereto.

The method for refining waste plastic pyrolysis oil according to the present invention has substantially the same technical concept as the apparatus for refining waste plastic pyrolysis oil described above, and includes: a dechlorination step of dechlorinating waste plastic pyrolysis oil and hydrogen under a first hydrotreating catalyst to produce a fluid including hydrogen chloride; a hydrogen chloride removal step of separating and removing hydrogen chloride from the fluid; and a denitrification step of denitrifying the fluid from which hydrogen chloride is separated under a second hydrotreating catalyst.

In the denitrification step, ammonia ($NH_3$) gas may be produced by the denitrification reaction, and the produced ammonia gas may react with hydrogen chloride to produce an ammonium salt. Therefore, the method for refining waste plastic pyrolysis oil according to an exemplary embodiment of the present invention may further include a step of discharging ammonia gas or mixed gas including the same, during the denitrification step or after the denitrification step. In addition, the fluid including the product from the dechlorination reaction, used as a reactant in the denitrification step may be used by introducing both gaseous hydrogen and an oil fraction discharged from the dechlorination step to the denitrification step. That is, it is preferred that the guard bed 100 which is the reactor which may be used in the dechlorination step has no separate gas outlet, and thus, the fluid including the product, unreactants, and the like of the dechlorination step may be introduced as it is to the denitrification step and react.

In the hydrogen chloride removal step, separate hydrogen is supplied to the fluid to remove hydrogen chloride, and the hydrogen chloride may be removed by replacing the hydrogen chloride with the hydrogen supplied.

In the method for refining waste plastic pyrolysis oil, for matters not further described, see the descriptions for the apparatus for refining waste plastic pyrolysis oil described above.

The refined oil obtained by the apparatus or the method for refining waste plastic according to the present invention has an extremely low content of impurities, and for example, may contain 10 ppm (weight) or less of chlorine, 30 ppm (weight) of less of nitrogen, 10 ppm (weight) or less of sulfur, 10 ppm (weight) or less of other metal components, 0.1 wt % or less of oxygen, 10 vol % or less of olefin, and 0.2 vol % or less of conjugated diolefin. However, this is described as a specific example, and the present invention is not interpreted as being limited thereto.

The refined oil obtained by the apparatus or the method for refining waste plastic according to an exemplary embodiment of the present invention may have various pour points, and for example, may be wax which has a pour point of 0° C. or higher and is solid at room temperature.

Hereinafter, the present invention will be described in detail by the Examples, however, the Examples are for describing the present invention in more detail, and the scope of the present invention is not limited to the following Examples.

Example 1

As shown in FIG. 1, an apparatus in which a guard bed which was a first reactor provided with a first hydrotreating catalyst inside and a main bed which was a second reactor provided with a second hydrotreating catalyst inside were connected in series was designed and operated to obtain refined oil from which impurities had been removed from waste plastic pyrolysis oil. The waste plastic pyrolysis oil was a hydrocarbon oil mixture containing a high concentration of impurities of 1,000 ppm of nitrogen (N), 700 ppm of chlorine (Cl), 18 wt % or more of olefin, and 2.3 vol % or more of conjugated diolefin.

Specifically, the guard bed was provided with NiMo/r-$Al_2O_3$, CoMo/r-$Al_2O_3$ which were a hydrotreating catalyst inside, and the waste plastic pyrolysis oil and hydrogen introduced to the inside of the guard bed, respectively reacted and a chlorine component was removed from the waste plastic pyrolysis oil, thereby producing hydrogen chloride which was a by-product. Besides, olefin, metal impurities, and the like were removed together from the waste plastic pyrolysis oil by the reaction, in addition to the chlorine component.

A fluid including waste plastic pyrolysis oil from which a chlorine component had been removed in the guard bed, hydrogen chloride, and unreacted hydrogen was introduced to the separator. Further, hydrogen chloride was discharged and removed in the separator, and separate hydrogen from a path different from the path to the guard bed was introduced to the separator and discharged, thereby replacing hydrogen chloride in the fluid present in the separator with the hydrogen, and discharging and removing the hydrogen chloride from the fluid. At this time, hydrogen chloride was discharged with a part of hydrogen from the separator.

The fluid including waste plastic pyrolysis oil and hydrogen from which hydrogen chloride had been removed was introduced from the separator to the main bed. The same hydrotreating catalyst as that described above was provided inside the main bed, and the waste plastic pyrolysis oil and hydrogen in the fluid introduced into the main bed reacted to remove a nitrogen component from the waste plastic pyrolysis oil, thereby producing ammonia which was a by-product. Besides, other remaining impurities such as a small amount of not-removed chlorine component, a sulfur component, and an oxygen component were removed together from the waste plastic pyrolysis oil by the reaction, in addition to the nitrogen component. Further, mixed gas including ammonia, a small amount of not-removed hydrogen chloride, water, hydrogen sulfide, hydrogen, and the like present inside the main bed was discharged from the main bed, and gas-liquid separation was performed from the mixed gas to obtain refined oil derived from waste plastic. Each operation condition of the guard bed, the separator, and the main bed is shown in the following Table 1.

TABLE 1

| | Guard bed | Separator | Main bed |
|---|---|---|---|
| Reactor type | Fixed bed | Bed/tank | Fixed bed |
| Reaction | HDCl, Olefin saturation, Metal removal | HCl gas separation | HDCl, HDN, HDS, HDO |
| Temperature (° C.) | 190 | 70 | 300 |
| Pressure(bar) | 60 | 1 | 100 |
| $H_2$/Oil ratio | 840 | 840 | 840 |
| Liquid hourly space velocity (LHSV) | 0.4 $h^{-1}$ | 0.07 $h^{-1}$ | 0.7 $h^{-1}$ |

Example 2

Refined oil was obtained in the same manner as in Example 1, except that the reaction temperature of the guard bed was the same as the temperature of the main bed.

Example 3

Refined oil was obtained in the same manner as in Example 1, except that the reaction temperature of the main bed was the same as the temperature of the guard bed.

Comparative Example 1

Refined oil was obtained in the same manner as in Example 1, except that the separator for removing hydrogen chloride was used at a rear end of the main bed which was the second reactor, that is, an apparatus in which the guard bed as the first reactor, the main bed as the second reactor, and the separator for removing hydrogen chloride were connected in series was used.

Comparative Example 2

Refined oil was obtained in the same manner as in Example 1, except that the separator for removing hydrogen chloride was not used, that is, an apparatus in which the guard bed as the first reactor and the main bed as the second reactor were connected in series was used.

[Experimental Example 1] Evaluation of Pressure Drop by Accumulation of Ammonium Salt ($NH_4Cl$)

The effect of suppressing an ammonium salt was evaluated by measuring an operable time without a problem of a pressure drop by Examples 1 to 3, and Comparative Examples 1 and 2. Specifically, refined oil was continuously produced by the apparatuses of each of the examples and the comparative examples, and at this time, a maximum operation time taken until a pressure loss (delta P) was 7 bar was measured, and the results therefor and whether Equation 1 was satisfied are shown in the following Table 2:

TABLE 2

| | | Examples | | | Comparative Examples | |
|---|---|---|---|---|---|---|
| | | 1 | 2 | 3 | 1 | 2 |
| Separator | Between guard bed and main bed | ○ | ○ | ○ | | |
| | Rear end of main bed | | | | ○ | |
| | No separator | | | | | ○ |
| $T_1$: Guard bed reaction temperature (° C.) | | 190 | 190 | 300 | 190 | 190 |
| $T_2$: Main bed reaction temperature (° C.) | | 300 | 190 | 300 | 300 | 300 |
| $Cl_0$ (ppm; weight) | | | | 700.0 | | |
| $Cl_1$ (ppm; weight) | | 360.5 | | 23.1 | 360.5 | |
| $N_0$ (ppm; weight) | | | | 1,000 | | |
| $N_1$ (ppm; weight) | | 957.1 | | 27.3 | 957.1 | |
| $N_2$ (ppm; weight) | | <1 | 837.6 | | <1 | |
| Maximum operation time (days) until pressure loss | | >14 | >14 | 3.5 | 2.3 | 2.3 |
| Equation 1 | Satisfied? | ○ | x | x | x | x |

$Cl_0$: weight of chlorine contained in waste plastic pyrolysis oil introduced to the guard bed
$Cl_1$: weight of chlorine in an oil fraction immediately after passing through the guard bed
$N_0$: weight of nitrogen contained in waste plastic pyrolysis oil introduced to the guard bed
$N_1$: weight of nitrogen in an oil fraction immediately after passing through the guard bed
$N_2$: weight of nitrogen in an oil fraction immediately after passing through the main bed The apparatus and the method for refining pyrolysis oil according to the present invention prevent or minimize production of an ammonium salt ($NH_4Cl$), and are excellent in prevention of corrosion of a reactor, improvement of durability, differential pressure occurrence, and process efficiency, in a process of refining waste plastic pyrolysis oil containing impurities including chlorine and nitrogen.

In addition, the apparatus and the method for refining pyrolysis oil according to the present invention have very low contents of impurities such as chlorine, nitrogen, metal, and the like, and olefin, and have excellent quality.

What is claimed is:

1. A method for refining waste plastic pyrolysis oil, the method comprising:

a dechlorination step of dechlorinating waste plastic pyrolysis oil with hydrogen in the presence of a first hydrotreating catalyst to produce a fluid including hydrogen chloride;

a hydrogen chloride removal step of separating and removing hydrogen chloride from the fluid, wherein in the hydrogen chloride removal step, separate hydrogen is supplied to the fluid to remove hydrogen chloride, and the hydrogen chloride is removed by replacing the hydrogen chloride with the hydrogen supplied; and a denitrification step of denitrifying the fluid from which hydrogen chloride is separated under a second hydrotreating catalyst.

2. The method for refining waste plastic pyrolysis oil of claim 1, wherein the dechlorination step is performed at a first temperature, and the denitrification step is performed at a second temperature higher than the first temperature.

3. The method for refining waste plastic pyrolysis oil of claim 2, wherein the first temperature is 100° C. to 280° C., and the second temperature is higher than 280° C. and up to 450° C.

* * * * *